US007396266B1

(12) United States Patent
Woods

(10) Patent No.: US 7,396,266 B1
(45) Date of Patent: Jul. 8, 2008

(54) DRIP BARRIER FOR WATERCRAFT PADDLE AND ASSOCIATED METHODS

(76) Inventor: David W. Woods, 3042 Hoffner Ave., Orlando, FL (US) 32812

( * ) Notice: Subject to any disclaimer, the term of this patent is extended or adjusted under 35 U.S.C. 154(b) by 0 days.

(21) Appl. No.: 11/692,425

(22) Filed: Mar. 28, 2007

(51) Int. Cl.
*B63H 16/04* (2006.01)

(52) U.S. Cl. ..... 440/101; 440/110

(58) Field of Classification Search ..... 440/101, 440/110; 416/74
See application file for complete search history.

(56) References Cited

U.S. PATENT DOCUMENTS

| | | | | |
|---|---|---|---|---|
| 1,398,894 | A | 11/1921 | Gaede | |
| 2,394,640 | A | 2/1946 | Singer | 15/248 |
| 2,602,172 | A | 7/1952 | Messman | 9/26 |
| 2,853,780 | A | 3/1958 | Bull | 30/327 |
| 2,838,058 | A | 6/1958 | Foltis et al. | 135/48 |
| 2,867,822 | A | 1/1959 | Downs | 9/24 |
| 5,114,371 | A | 5/1992 | Alonzo | 441/129 |
| 5,135,422 | A | 8/1992 | Bowen | 446/15 |
| 5,851,132 | A | 12/1998 | Merrill | 440/101 |
| 7,124,702 | B1 * | 10/2006 | Cameron | 114/352 |
| 2002/0147056 | A1 | 10/2002 | Sukenik | 473/300 |
| 2003/0121118 | A1 | 7/2003 | Matsuda | 15/248.1 |

FOREIGN PATENT DOCUMENTS

| | | |
|---|---|---|
| JP | 2003-348 | 1/2003 |

* cited by examiner

*Primary Examiner*—Sherman Basinger
(74) *Attorney, Agent, or Firm*—Allen, Dyer, Doppelt, Milbrath & Gilchrist, P.A.

(57) ABSTRACT

A watercraft paddle may include a shaft having first and second ends and at least one grip position therebetween for a user's hand. The paddle may further include a blade carried by the first end of the shaft, and at least one drip barrier positioned between the at least one grip position and the blade. The at least one drip barrier may include a base surrounding the shaft, and a concave sidewall portion extending vertically from the base toward the blade and curved laterally inward toward the shaft to define a water collection reservoir with the base for collecting water drippage from the blade along the shaft. The concave sidewall portion may have an arclength spanning greater than ninety degrees.

17 Claims, 4 Drawing Sheets

DRIP BARRIER FOR WATERCRAFT PADDLE AND ASSOCIATED METHODS

FIELD OF THE INVENTION

The present invention relates to the field of watercraft, and, more particularly, to drip barriers for watercraft paddles and related methods.

BACKGROUND OF THE INVENTION

Many paddles, particularly kayak paddles, include a rubber drip barrier on the shaft positioned between the paddle blade and the area where the user holds the paddle. The drip barrier is essentially a rubber washer that deflects water running down the shaft when the user lifts the paddle blade, to reduce the amount of water contacting the user's hands and body. Such drip barriers are discussed in U.S. Pat. No. 5,851,132 to Merrill, for example.

Drip guards are sometimes used in other applications as well. For example, a cup-shaped attachment for the end of an umbrella is disclosed in U.S. Pat. No. 2,838,058 to Foltis et al, including a curved convex exterior. Another example is set forth in U.S. Pat. No. 1,398,894 to Gaede, which discloses a drip barrier for toothbrushes including a receptacle through which a brush shaft is passed. Deflectors on the inner wall of the receptacle and the shaft portion enclosed by the receptacle prevent liquid flowing out of the receptacle. Another similar example is U.S. Pat. No. 2,394,640 to Singer which discloses an attachment for a toothbrush shaft having a bell-like shape.

Although typical drip barriers for paddle shafts provide some degree of water deflection away from the paddle user's hand on a paddle shaft, such drip guards often still allow water to drip off onto the user or inside the watercraft. Other drip barriers, such as those noted above, are not designed for the extended and rigorous use that a watercraft paddle is subjected to, nor the wide range of motion through which a paddle typically travels.

SUMMARY OF THE INVENTION

In view of the foregoing background, it is therefore an object of the present invention to provide a drip barrier for watercraft paddles and related methods.

This and other objects, features, and advantages are provided by a watercraft paddle which may include a shaft having first and second ends and at least one grip position therebetween for a user's hand. The paddle may further include a blade carried by the first end of the shaft, and at least one drip barrier positioned between the at least one grip position and the blade. More particularly, the at least one drip barrier may include a base surrounding the shaft and a concave sidewall portion extending vertically from the base toward the blade and curved laterally inward toward the shaft to define a water collection reservoir with the base for collecting water drippage from the blade along the shaft. Moreover, the concave sidewall portion may have an arclength spanning greater than ninety degrees.

In addition, the concave sidewall portion may have a rounded upper lip opposite the base. More particularly, the rounded upper lip may curve outward away from the shaft. Also, the at least one drip barrier may further include a water deflection ridge carried on an outer surface of the sidewall portion.

Furthermore, the at least one drip barrier may include at least one raised sealing ridge carried by the base and contacting the shaft. Moreover, the least one raised sealing ridge may be a plurality of spaced apart raised sealing ridges. Additionally, the blade may be a first blade, and the watercraft paddle may further include a second blade carried by the second end of the shaft. In some embodiments, the concave sidewall portion may be removably connected to the base. Also, the at least one drip barrier may comprise a pliable material, such as rubber, for example.

Other advantageous aspects include a drip barrier for a watercraft paddle, such as the one described briefly above, as well as a method for reducing water drippage along a shaft of a watercraft paddle using such a drip guard.

In accordance with another advantageous embodiment, a drip barrier system is for a plurality of watercraft paddles, where each watercraft paddle includes a shaft having first and second ends and at least one grip position therebetween for a user's hand, and a blade carried by the first end of the shaft. Additionally, each shaft may have a portion with one of a plurality of different diameters between its grip position and blade. The drip barrier system may include a plurality of bases each having an opening therethrough sized to fit a respective one of the plurality of different diameter shaft portions, and a sidewall portion interchangeably connectable to each of the bases to define a water collection reservoir therewith.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
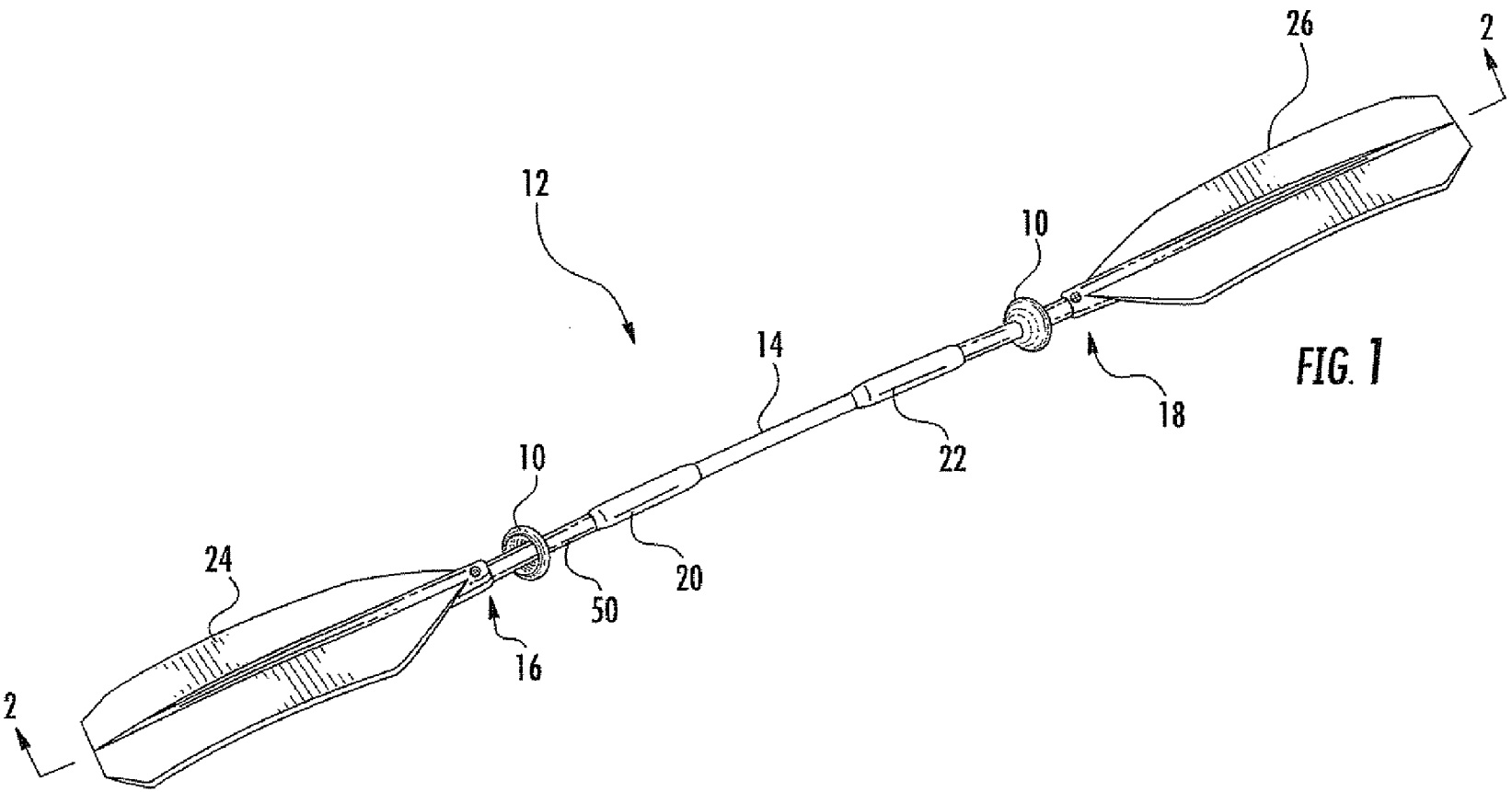
FIG. 1 is a perspective view of a watercraft paddle including a drip barrier according to the present invention.

Referring initially to FIG. 1, a drip barrier 10 for a watercraft paddle 12 for a watercraft such as a kayak, canoe, etc., is now described. The watercraft paddle 12 (a kayak paddle in the exemplary embodiment) illustratively includes a shaft 14 having first and second ends 16, 18, first and second grip positions 20, 22 on the shaft for a user's hands, and first and second blades 24, 26 respectively carried by the first and second ends of the shaft. In the illustrated embodiment, a respective drip barrier 10 is positioned between the first end 16 and first grip 20, and the second end 18 and second grip 22 as shown, although a drip barrier need not be included on each end of the shaft in all embodiments. Moreover, the drip barrier 10 could also be used on a single-bladed paddle, as will be appreciated by those skilled in the art.

Figure 2:
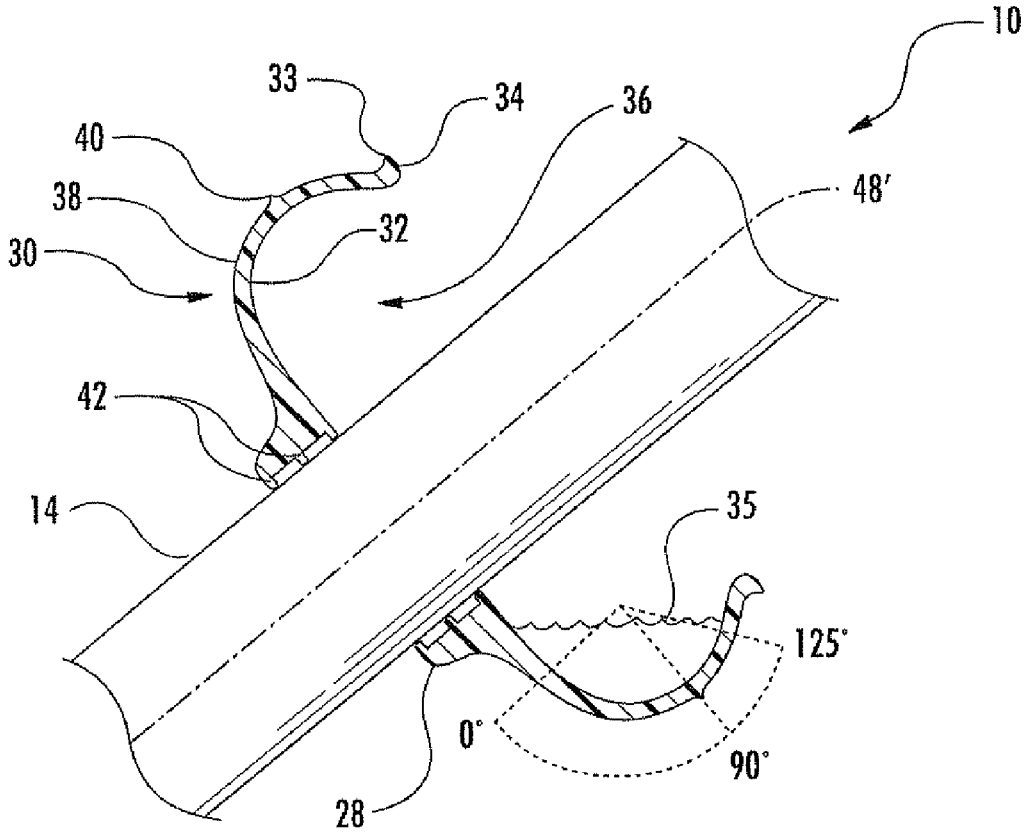
FIG. 2 is a longitudinal cross-sectional view of the drip barrier of FIG. 1 taken along line 2-2 in a raised position.
Figure 3:
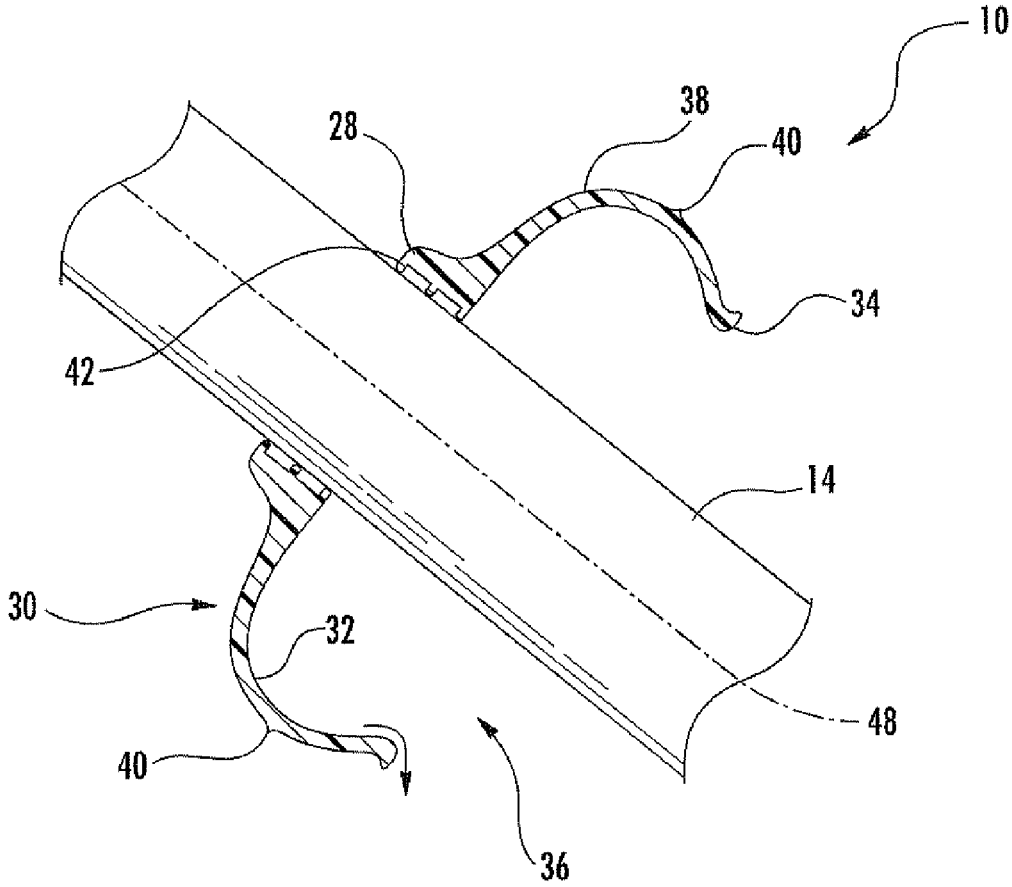
FIG. 3 is a longitudinal cross-sectional view of the drip barrier of FIG. 2 in a lowered position.

Turning now additionally to FIGS. 2 and 3, the drip barrier 10 illustratively includes a base 28 surrounding the shaft 14, and a concave sidewall portion 30 extending from the base toward the blade 24 (or 26). The sidewall portion 30 has an inner surface 32 adjacent (i.e., facing) the shaft 14, an outer surface 38 opposite the inner surface, and a rounded upper lip 34. As can be seen, the tip of the rounded upper lip in the illustrated example curves outward away from the shaft 14 and is brought to a point 33. However, an outward-curving or rounded upper lip need not be used in all embodiments. Moreover, the sidewall portion 30 need not be curved in all embodiments (e.g., the sidewalls may be linear).

The base 28 and the inner surface 32 of the concave sidewall portion 30 advantageously define a water collection reservoir 36 for collecting water drippage along the shaft 14 from the blade 24 (or 26). The water collection reservoir 36 is preferably sized to accommodate a volume of water 35 expected to run down the paddle shaft 14 from the paddle blade 24 (or 26) upon moving the paddle blade from a lowered position in the water (FIG. 3) to a raised position out of the water (FIG. 2), as occurs during a typical kayak paddling stroke. The water collection reservoir 36 has a bottom portion that is substantially perpendicular to the shaft 14, as seen in FIGS. 2 and 3, for example.

When in the raised position, the water collection reservoir 36 of the drip barrier 10 advantageously collects the water 35 where it is held until the blade 24 (or 26) is lowered outside of the watercraft. By way of contrast, typical prior art paddle drip rings merely deflect water from the paddle blade off of the shaft when the paddle is in a raised position. Yet, if the user raises the drip ring over the watercraft or himself, then water will still drip off in the watercraft or on the user.

The rounded upper lip 34 and point 33 advantageously function as a "drip round" for deflecting water from running around the side of the drip barrier 10 and onto the grip position 20 when the paddle is lowered and the water 35 is dumped out of the drip barrier 10, as shown by the arrow in FIG. 3. Stated alternatively, the rounded upper lip 34 and point 33 allow water to release when poured out and help keep the water from running around the tip of the sidewall portion, which would otherwise result in drippage along the shaft 14 and onto the first or second grip positions 20, 22 when the blade 24 (or 26) is once again raised.

In some embodiments the drip barrier 10 may also include a water deflection ridge 40 carried on the outer surface 38 of the sidewall portion 30. The water deflection ridge 40 advantageously assists in deflecting or releasing water on the outer surface 38 of the sidewall portion 30, which may occur when the drip barrier 10 is dipped in the water, for example.

In the illustrated embodiment, the sidewall portion 30 has a generally concave longitudinal cross-section as shown that curves inwardly toward the shaft 14. Generally speaking, the length and amount of inward curve is preferably great enough to provide a water collection reservoir 36 with a sufficient capacity collect all of the water that enters therein from a given shaft angle with little or no water splash-out or spillover, but not so deep as to retain water in the collection reservoir or cause water to run around the tip of the sidewall portion 30 when the blade 24 (or 26) is in the lower position. Preferably, substantially all of the water is allowed to drain from the water collection reservoir 36 when in the lowered position.

By way of example, the arclength of the concave curve preferably spans greater than ninety degrees. In the present example, from the base 28 the sidewall portion 30 defines a curve that extends out away from the shaft 14 to the ninety degree position (FIG. 2), and then continues to curve back in toward the shaft 14, here to about the 125 degree position. Of course, greater or lesser arclengths may be used in different embodiments. Moreover, it should also be noted that the curve of the concave sidewall portion need not be circular, i.e., it could be an elliptical curve, for example.

In the illustrated example, the water deflection ridge 40 is carried at an apex portion of the outer surface 38 of the sidewall portion 30, which in the present example is at about the ninety degree position along the curve of the sidewall portion. That is, the curvature of the sidewall portion 30 defines an apex portion on the outer surface 38, and the water deflection ridge 40 is carried on the outer surface adjacent the apex portion and protrudes outwardly from the outer surface away from the water collection reservoir 36 as shown in FIGS. 2 and 3. However, it should be noted that the water deflection ridge 40 may be located at other positions along the outer surface 38 of the sidewall portion. Moreover, in some embodiments more than one water deflection ridge 40 may be carried at various positions along the outer surface 38 of the sidewall portion 30, or the water deflection ridge may be omitted altogether.

To provide a good seal between the shaft 14 and the base 28, the drip barrier 10 may further include one or more raised sealing ridges 42 carried by the base on the sidewalls of the opening therethrough for contacting the shaft. The sealing ridge(s) 42 advantageously provides a friction fit around the shaft 14 to help prevent water from seeping therethrough toward the grip positions 20, 22. The sealing ridge(s) 42 may be compressible and/or stretchable in a direction perpendicular to a longitudinal axis 48 of the shaft 14 to accommodate shafts of varying diameters. The drip barrier 10 may be made out of a pliable material, such as rubber, silicone, or other suitable materials, for example.

Figure 4:
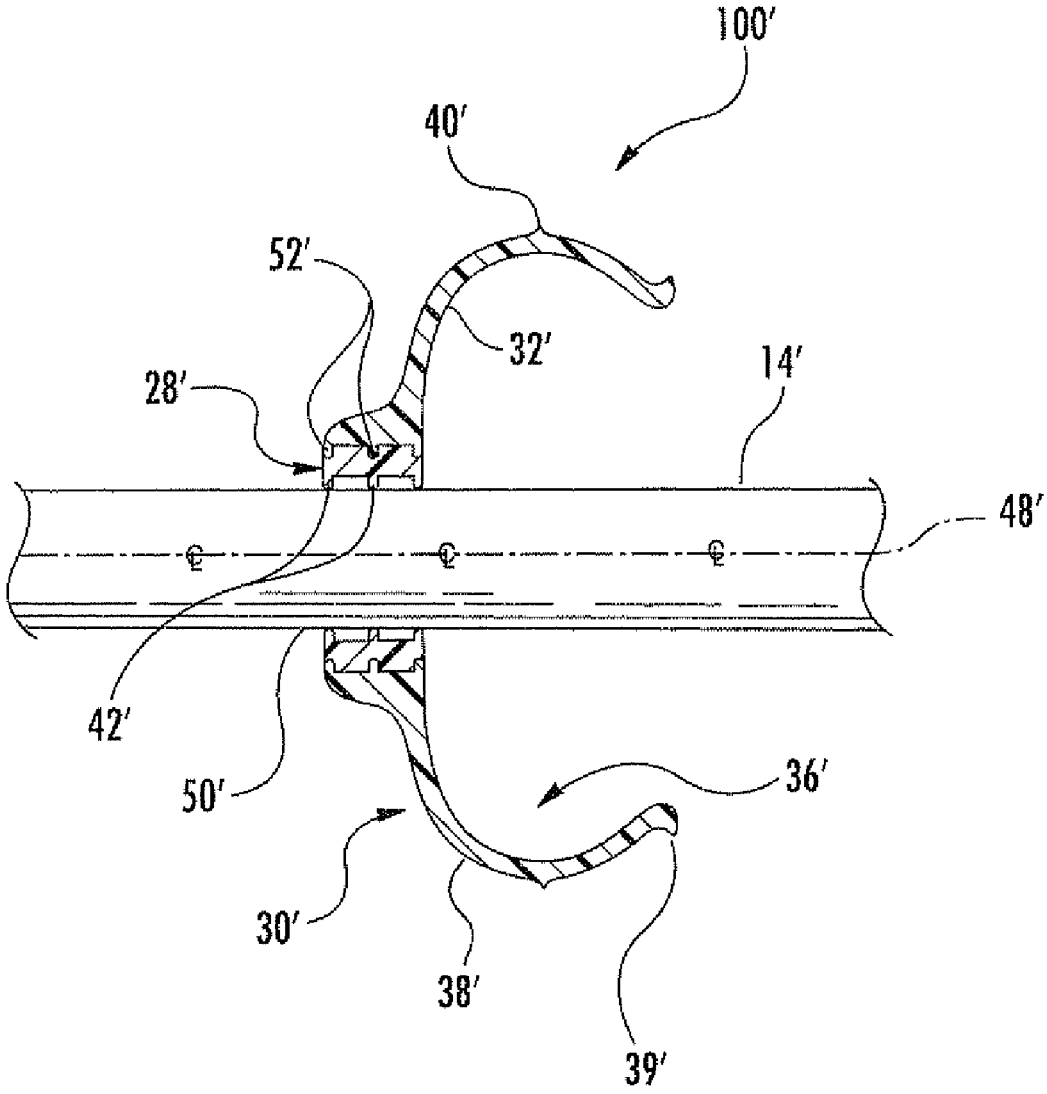
FIG. 4 is a longitudinal cross-sectional view of an alternative embodiment of the drip barrier of FIG. 2 with an interchangeable base.

In another embodiment now described with reference to FIG. 4, a drip barrier system 100' illustratively includes a sidewall portion 30' that is removably connected to a plurality of different bases 28'. That is, different bases 28' may be used for different watercraft paddles 12' with shafts 14' of different diameters. More particularly, each watercraft paddle 12' may have a shaft with one of a plurality of different diameters between its grip position 20' and blade 24' (or 26'). Thus, each base 28' may advantageously have an opening therethrough sized to fit a respective one of the plurality of different diameter shaft portions 50' (i.e., the bases have different size shaft openings therethrough). Because the sidewall portion 30' is interchangeably connectable to each of the bases 28' to define a water collection reservoir 36' therewith, a user may advantageously leave the bases 28' on respective paddles 12' and interchange the sidewall portion 30' as needed.

Each sidewall portion 30' may include a plurality of raised sealing ridges 52' for engaging grooves 56' in the outer surface of a base 28' to provide a guide for insertion and an improved water seal, as will be appreciated by those skilled in the art. The bases 28' preferably have a same outer diameter so the same sidewall portion 30' will fit them all. However, the bases 28' may have different outer diameters in different embodiments.

The shaft 14 may be metal, wood, plastic, or other suitable materials, as will be appreciated by those of skill in the art. The grip positions 20, 22 along the shaft 14 may be bare portions of the shaft, textured portions of the shaft, or there may be a grip material surrounding the shaft, such as rubber or plastic, for example. The paddle blades 24, 26 may be wood, plastic, or other suitable materials. Is should also be noted that the shaft 14 need not be circular in all embodiments.

Moreover, it should also be noted that the above-described drip barrier 10 may more generally be used for other applications on a shaft that is to be alternately dipped into a liquid (which may be water or another liquid) and raised out to a point where the liquid would otherwise undesirably run down the shaft, or where shafts are otherwise exposed to a liquid and moved between raised and lowered positions. By way of example, the drip barrier 10 could be used on umbrellas, toothbrushes, paint brushes/rollers, kitchen utensils, fishing rods, and in other applications that will be appreciated by those skilled in the art.

A method aspect is for reducing water drippage along a shaft 14 of a paddle 12 from a blade 24 at a first end 16 of the shaft to a user's hand on a grip position 20 on the shaft. The method may include positioning a drip barrier 10 as described above between the grip position 20 (or 22) and the blade 24 (or 26) of a paddle 12 so that the sidewall portion 30 extends from the base toward the paddle blade, as described further above.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. A watercraft paddle comprising:

a shaft having first and second ends and at least one grip position therebetween for a user's hand;

a blade carried by the first end of said shaft; and at least one drip barrier positioned between the at least one grip position and said blade, said at least one drip barrier comprising a base surrounding said shaft, a concave sidewall portion extending from said base toward said blade and curved inward toward said shaft to define a water collection reservoir with said base for collecting water drippage from said blade along said shaft, the water collection reservoir having a bottom portion that is substantially perpendicular to said shaft, said concave sidewall portion having an arclength spanning greater than ninety degrees, and having an upper lip opposite the first section curving outwardly away from said shaft, wherein the curvature of said concave sidewall portion defines an apex portion on an outer surface thereof, and a water deflection ridge carried on the outer surface of said concave sidewall portion adjacent the apex portion and protruding outwardly from the outer surface away from the water collection reservoir.

2. The watercraft paddle of claim 1 wherein the upper lip is rounded.

3. The watercraft paddle of claim 1 wherein said at least one drip barrier further comprises at least one raised sealing ridge carried by said base and contacting said shaft.

4. The watercraft paddle of claim 3 wherein said at least one raised sealing ridge comprises a plurality of spaced apart sealing ridges.

5. The watercraft paddle of claim 1 wherein said blade comprises a first blade; and further comprising a second blade carried by the second end of said shaft.

6. The watercraft paddle of claim 1 wherein said concave sidewall portion is removably connected to said base.

7. The watercraft paddle of claim 1 wherein said at least one drip barrier comprises rubber.

8. A drip barrier for a paddle comprising a shaft having first and second ends and at least one grip position therebetween for a user's hand, and a blade carried by the first end of the shaft, the drip barrier comprising:

a base having an opening therein for receiving the shaft;

a sidewall portion extending from said base toward the blade and curved inward toward the shaft to define a water collection reservoir therewith for collecting water drippage from the blade along the shaft;

wherein the water collection reservoir has a bottom portion that is substantially perpendicular to said shaft;

wherein the sidewall portion has an arclength spanning greater than ninety degrees;

wherein the sidewall portion has an upper lip opposite the first section curving outwardly away from the shaft when the drip barrier is positioned thereon, wherein the curvature of said sidewall portion defines an apex portion on an outer surface thereof; and a water deflection ridge carried on the outer surface of said sidewall portion adjacent the apex portion and protruding outwardly from the outer surface away from the water collection reservoir.

9. The drip barrier of claim 8 wherein said upper lip is rounded.

10. The drip barrier of claim 8 further comprising a plurality of spaced apart raised sealing ridges carried by the base within the opening for contacting the shaft.

11. A drip barrier system for a plurality of watercraft paddles each comprising a shaft having first and second ends and at least one grip position therebetween for a user's hand, and a blade carried by the first end of the shaft, each shaft having a portion with one of a plurality of different diameters between its grip position and blade, the system comprising:

a plurality of bases each having an opening therethrough sized to fit a respective one of the plurality of different diameter shaft portions;

a sidewall portion interchangeably connectable to each of said bases to define a water collection reservoir therewith, said sidewall portion extending from said base toward the blade and curved inward toward the shaft to define the water collection reservoir, the water collection reservoir having a bottom portion that is substantially perpendicular to the shaft;

wherein the sidewall portion has an upper lip opposite the first section curving outwardly away from the shaft when the drip barrier is positioned thereon;

wherein the curvature of said sidewall portion defines an apex portion on an outer surface thereof; and a water deflection ridge carried on the outer surface of said sidewall portion adjacent the apex portion and protruding outwardly from the outer surface away from the water collection reservoir.

12. The drip barrier system of claim 11 wherein the upper lip is rounded.

13. The drip barrier system of claim 11 further comprising at least one raised sealing ridge carried by each of the bases within the opening thereof.

14. The drip barrier system of claim 11 wherein said plurality of bases have a same outer diameter.

15. A method for reducing water drippage along a shaft of a watercraft paddle from a blade at a first end of the shaft to a user's hands on a grip position on the shaft between the first and second ends of the shaft, the method comprising:

positioning a drip barrier between the grip position and the blade, the drip barrier comprising a base surrounding the shaft, a concave sidewall portion extending from the base toward the blade and curved inward toward the shaft to define a water collection reservoir with the base for collecting water drippage from the blade along the shaft, the water collection reservoir having a bottom portion that is substantially perpendicular to the shaft, and the concave sidewall portion having an arclength spanning greater than ninety degrees;

wherein the sidewall portion also has an upper lip opposite the first section and curves outwardly away from the shaft when the drip barrier is positioned thereon;

wherein the curvature of the concave sidewall portion defines an apex portion on an outer surface thereof; and wherein the drip barrier further comprises a water deflection ridge carried on the outer surface of the concave sidewall portion adjacent the apex portion and protruding outwardly from the outer surface away from the water collection reservoir.

16. The method of claim 15 wherein the at least one drip barrier further comprises at least one raised sealing ridge carried by the base and contacting the shaft.

17. The method of claim 15 wherein positioning the drip barrier comprises:

positioning the base on the shaft between the grip position and the blade; and connecting the sidewall portion to the base so that the sidewall portion extends toward the paddle blade.

* * * * *